US008866862B2

(12) United States Patent
Arima

(10) Patent No.: US 8,866,862 B2
(45) Date of Patent: Oct. 21, 2014

(54) IMAGE FORMING APPARATUS

(71) Applicants: Kabushiki Kaisha Toshiba, Tokyo (JP); Toshiba Tec Kabushiki Kaisha, Tokyo (JP)

(72) Inventor: Yasuharu Arima, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/090,895

(22) Filed: Nov. 26, 2013

(65) Prior Publication Data

US 2014/0192127 A1 Jul. 10, 2014

(30) Foreign Application Priority Data

Jan. 9, 2013 (JP) ..... 2013-001533

(51) Int. Cl.
*B41J 29/00* (2006.01)
*B41M 7/00* (2006.01)
*B41J 29/36* (2006.01)

(52) U.S. Cl.
CPC ..... *B41J 29/36* (2013.01); *B41M 7/0009* (2013.01)
USPC ..... 347/179

(58) Field of Classification Search
USPC ..... 347/212
See application file for complete search history.

(56) References Cited

U.S. PATENT DOCUMENTS

| | | | | |
|---|---|---|---|---|
| 8,077,191 | B2 * | 12/2011 | Brewington et al. | 347/171 |
| 8,538,280 | B2 | 9/2013 | Yahata et al. | |
| 2011/0305851 | A1 * | 12/2011 | Wang et al. | 428/32.31 |
| 2012/0325101 | A1 | 12/2012 | Tanaka et al. | |
| 2013/0016376 | A1 | 1/2013 | Hashidume et al. | |
| 2013/0070266 | A1 | 3/2013 | Hagiwara et al. | |

* cited by examiner

*Primary Examiner* — Huan Tran
(74) *Attorney, Agent, or Firm* — Patterson & Sheridan LLP

(57) ABSTRACT

According to the above-described embodiment, provided is an image forming apparatus that has an image forming function of forming an image on a recording medium and an erasing function of erasing an image formed on a recording medium. The image forming apparatus includes an image forming unit, a delivery unit, and an image erasing unit. The delivery unit delivers information requiring users to supply a recording medium having an image formed thereon by an erasable color material to the apparatus.

10 Claims, 6 Drawing Sheets

IMAGE FORMING APPARATUS

CROSS-REFERENCE TO RELATED APPLICATION

This application is based upon and claims the benefit of priority from the prior Japanese Patent Application No. 2013-1533, filed on Jan. 9, 2013, the entire contents of which are incorporated herein by reference.

FIELD

Embodiments described herein relate generally to an image forming apparatus that has a function of forming an image on a recording medium by an erasable color material and a function of erasing an image formed on a recording medium.

BACKGROUND

Hitherto, an image forming apparatus has been provided which has an image forming function of printing an image for printing information including characters or figures by an erasable color material and an image erasing function of erasing an image printed on a sheet. The image forming apparatus includes the image forming function and the image erasing function in order to reuse the sheet. The image forming apparatus reads the image printed on the sheet by an image reading unit. The image forming apparatus converts the image read by the image reading unit into electronic data, and stores the electronic data in a storage unit. The image forming apparatus determines whether the image printed on the sheet is erasable based on the stored electronic data, and erases the image in accordance with the determination result.

However, even when the image is printed on the sheet by the image forming function, a user may want to keep the sheet without erasing the image thereon, and hence the sheet having an image printed thereon may not be reused in some cases. Hereinafter, the sheet from which the printed image is erased will be referred to as a reused sheet. Accordingly, there is a case in which reused sheets run out when the user wants to print an image thereon, and hence a new sheet needs to be inevitably used. In other words, there is a problem in that the function of reusing the sheet by the user in the image forming apparatus is not utilized skillfully.

DETAILED DESCRIPTION

Figure 1:
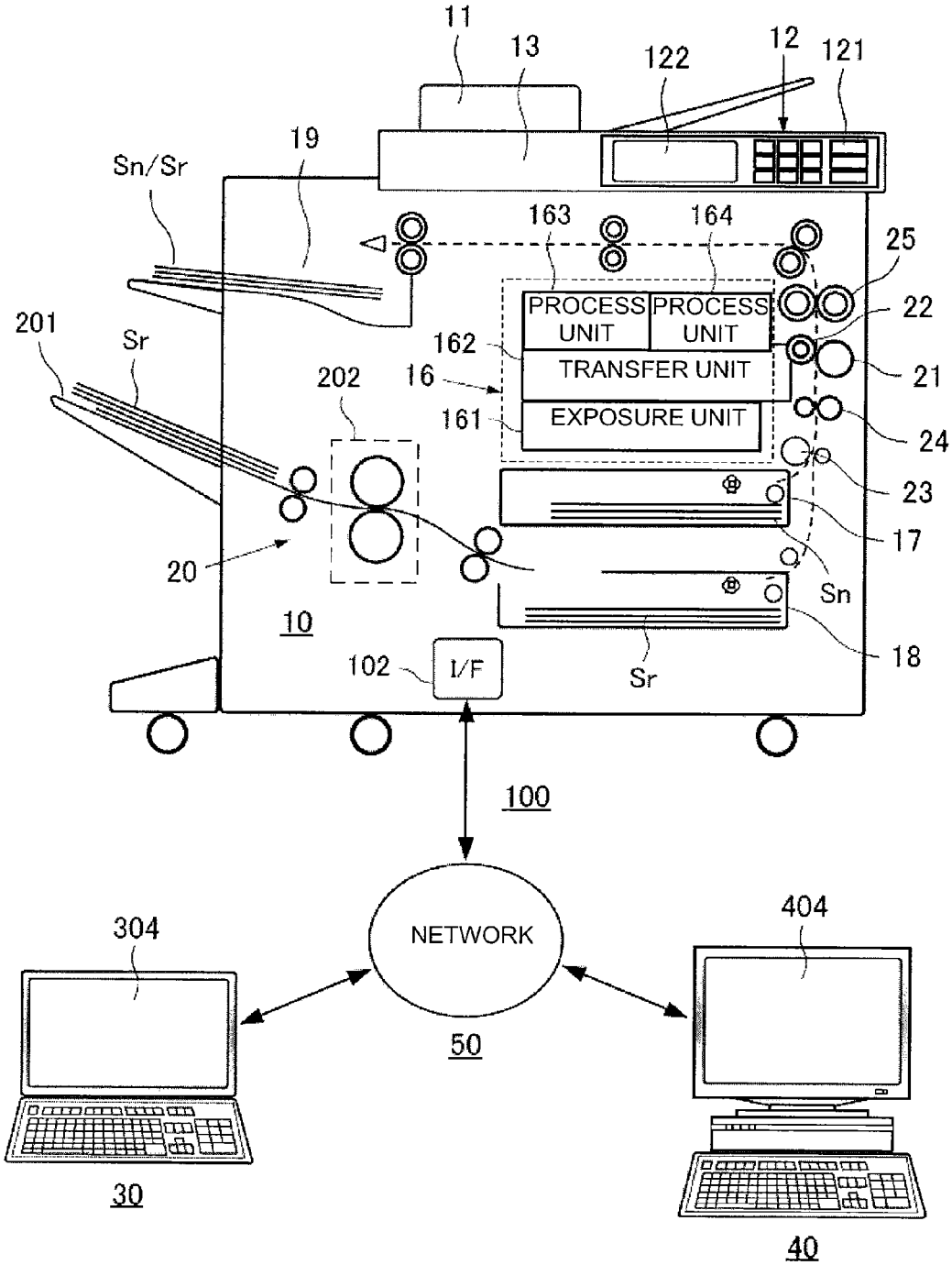
FIG. 1 is a diagram illustrating an image forming apparatus according to a first embodiment and an image forming system including the image forming apparatus.

According to embodiments, provided is an image forming apparatus that has an image forming function of forming an image on a recording medium and an erasing function of erasing an image formed on a recording medium. The image forming apparatus includes an image forming unit, a delivery unit, and an erasing unit. The image forming unit forms an image on the recording medium by using an erasable color material and an inerasable color material. The delivery unit transmits information requiring a user to supply the recording medium having the image formed thereon by the erasable color material to the apparatus. The erasing unit erases the image formed on the recording medium supplied to the apparatus.

Hereinafter, the embodiments will be described further by referring to the drawings. In the drawings, the same reference numerals indicate the same or similar components.

A first embodiment will be described by referring to FIG. 1. FIG. 1 is a diagram illustrating an image forming apparatus 10 according to the first embodiment and an image forming system 100 including the image forming apparatus. The image forming apparatus 10 is an MFP (Multi Function Peripheral) that has multiple functions such as an image forming function, an image erasing function, a scan function, and a facsimile function.

As illustrated in FIG. 1, the image forming system 100 includes the image forming apparatus 10 and client terminals 30 and 40 that are connected to the image forming apparatus 10 via a network. Each of the client terminals 30 and 40 is a note PC (Personal computer), a laptop PC, a desktop PC, or a tablet PC. The client terminals 30 and 40 have a function of receiving an e-mail from at least the MFP 10 and displaying the content thereof. Each of the client terminals 30 and 40 may be a portable terminal such as a smart phone.

The image forming apparatus 10 includes a document conveying device 11, an operation panel 12, a scanner 13, a printer unit 16, an unused sheet cassette 17, a reuse sheet cassette 18, and a sheet discharging unit 19. The image forming apparatus 10 further includes an erasing unit 20.

The cassettes 17 and 18 accommodate recording mediums, for example, sheets, and supply the recording mediums to the printer unit 16. The unused sheet cassette 17 accommodates unused sheets Sn. The reused sheet cassette 18 accommodates reused sheets Sr. The reused sheet Sr is a sheet from which an image printed thereon at least once is erased. The unused sheet Sn is a sheet on which an image is not printed at all. As the image forming function, the image forming apparatus 10 has a first image forming function of printing an image on a sheet by using an erasable color material, for example, an erasable toner and a second image forming function of printing an image on a sheet by using an inerasable toner. Hereinafter, the sheet on which the image is printed by the first image forming function will be referred to as a reusable sheet. As the image erasing function, the image forming apparatus 10 further has a function of erasing the image printed on the reusable sheet. The image forming apparatus 10 has the first image forming function and the image erasing function in order to reuse the sheet.

The unused sheet Sn includes a sheet in which no image has been printed on a second face (a rear face) while an image has already been printed on a first face (a front face). The image of the first face may be an image that is printed by using any one image forming function of the first image forming function and the second image forming function.

The document conveying device 11 is installed on a platen of the scanner 13 so as to be openable and closable. The document conveying device 11 automatically conveys a document to a document reading position of the scanner 13.

Figure 2:
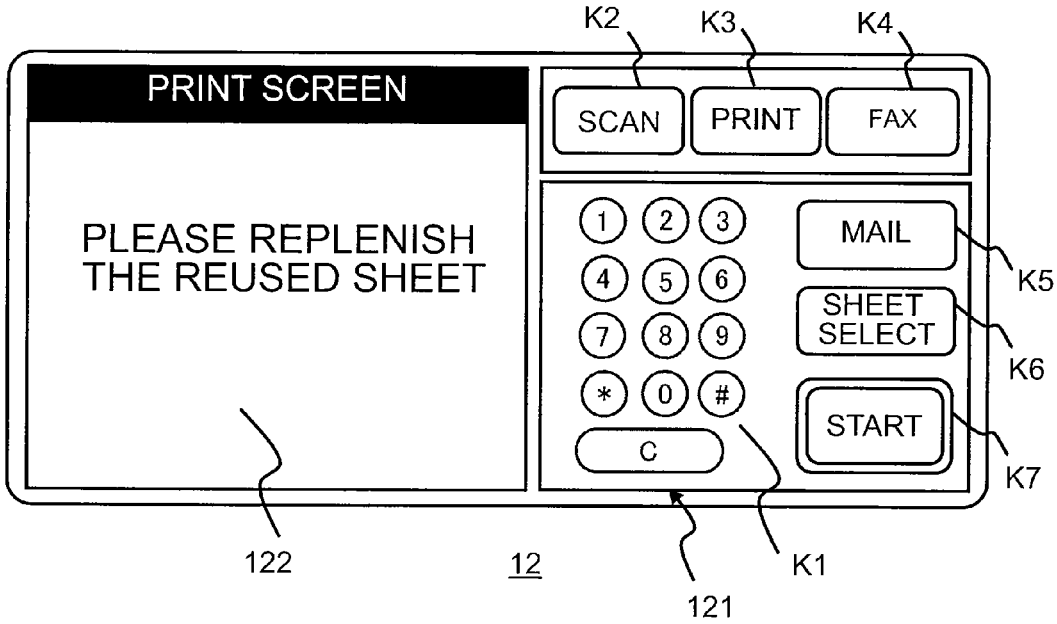
FIG. 2 is a diagram illustrating an operation panel that is used in the image forming apparatus according to the first embodiment.

FIG. 2 is a diagram illustrating the operation panel 12 that is used in the image forming apparatus 10. As illustrated in FIG. 2, the operation panel 12 is an acquiring unit that includes an input unit 121 with various keys and a display unit 122 and acquires information on a user ID (Identification Data) number and setting information of the above-described functions. The display unit 122 displays various information items such as the setting information or the operation state of the image forming apparatus 10.

The input unit 121 includes a numerical key K1 for inputting the quantity of printing sheets, a FAX number, an ID number, a mail address, and the like, a scan key K2 (SCAN), an image formation key K3 (PRINT), a facsimile key K4 (FAX), a mail sending key K5 (MAIL), a sheet selecting key K6 (SHEET SELECT), a start key K7 (START), and the like. The input unit 121 may be configured by, for example, a numerical input key, a keyboard, a mouse, a touch panel, a touchpad, a pen tablet (graphics tablet), or a dedicated button.

The display unit 122 may be configured by, for example, an electronic paper, an LCD (Liquid crystal display), or an EL (Electronic Luminescence). When the display unit 122 is configured by a touch panel display, a part or the entirety of the functions of the input unit 121 may be realized.

The scanner 13 is a general image reading device that is installed in a copying machine or an image scanner. The image forming apparatus 10 uses the scanner 13 when a document is copied by the image forming function or a document is scanned by the scan function.

The printer unit 16 is an image forming unit that forms an image on a sheet by an electrophotographic scheme. In order to form an image by the electrophotographic scheme, the printer unit 16 includes an exposure unit 161, a transfer unit 162, and process units 163 and 164. For the second image forming function, the process unit 163 includes a photosensitive drum for an inerasable toner and a developing unit for an inerasable toner. For the first image forming function, the process unit 164 includes a photosensitive drum for an erasable toner and a developing unit for an erasable toner. The printer unit 16 forms an image on the unused sheet Sn or the reused sheet Sr by processing image data obtained by reading a document using the scanner 13 or image data created by PCs as the client terminals 30 and 40 and transmitted via a network. The sheet discharging unit 19 discharges the sheet having an image formed thereon by the printer unit 16 to the outside of the image forming apparatus 10.

In the image forming apparatus 10, the image data which becomes the basis of the image printed on the sheet may be acquired from the scanner 13 as described above or may be acquired from the PCs as the client terminals 30 and 40 via the network as described above. Accordingly, the first and second image forming functions of the image forming apparatus 10 include a copying function of printing an image on the sheet based on the image data acquired from the scanner 13 and a printing function of printing an image on the sheet based on the image data acquired from the PCs.

The exposure unit 161 includes a semiconductor laser element that emits a laser beam modulated by the image data. Further, the exposure unit 161 includes a polygon mirror that emits a laser beam toward the photosensitive drum rotated by the process units 163 and 164 so as to scan the photosensitive drum in the axial direction by the laser beam. The exposure unit 161 forms an electrostatic latent image on the photosensitive drum by emitting a laser beam thereto.

The developing units of the process units 163 and 164 form toner images on the photosensitive drums by supplying a toner to the photosensitive drums so as to develop the electrostatic latent image.

The transfer unit 162 includes a transfer roller 21, a transfer belt (not illustrated), and a drive roller 22 that supports and drives the transfer belt. The transfer belt is installed so as to contact the photosensitive drums of the process units 163 and 164 at a primary transfer position and to contact the transfer roller 21 at a secondary transfer position. The transfer unit 162 transfers the toner image from the photosensitive drum to the transfer belt at the primary transfer position. The transfer belt is driven by the drive roller 22 so as to run in an endless state while carrying the toner image thereon. The transfer roller 21 transfers the toner image from the transfer belt to the sheet at the secondary transfer position.

The image forming apparatus 10 includes a separation roller 23 and a registration roller 24 which are installed in a region from the unused sheet cassette 17 or the reused sheet cassette 18 to the sheet discharging unit 19. The separation roller 23 separates the sheets Sn taken out from the cassette 17 or the sheets Sr taken out from the cassette 18 and conveys the sheets one by one.

The registration roller 24 conveys the sheet conveyed by the separation roller 23 to a position between the transfer belt and the transfer roller 21 as the secondary transfer position so as to match the timing at which the toner image is conveyed by the transfer belt. A transfer voltage is applied to the transfer roller at the time when the sheet passes by the secondary transfer position. Accordingly, the transfer roller 21 transfers the toner image from the transfer belt onto the sheet as described above.

The image forming apparatus 10 includes a fixing unit 25. The fixing unit 25 is installed at the downstream position of the transfer unit 162 and the upstream position of the sheet discharging unit 19 in the sheet conveying direction using the registration roller 24. The fixing unit 25 heats and pressurizes the toner image transferred onto the sheet so as to fix the toner image onto the sheet. When the toner image is fixed onto the sheet, the image is completely printed. The sheet discharging unit 19 discharges the sheet having an image printed thereon to the outside of the image forming apparatus 10. For example, when printing an image on both faces of the sheet, the image forming apparatus 10 uses, for example, a sheet reversing and conveying device that reverses the first face and the second face of the sheet after the toner image is fixed onto the first face of the sheet and resends the sheet to the secondary transfer position.

The erasing unit 20 includes a sheet input tray 201 and a heating unit 202. The sheet input tray 201 guides the reusable sheet input by the user to the heating unit 202. The user inputs the reusable sheet into the sheet input tray 201. The heating unit 202 includes a heater such as a heater lamp. The heating unit 202 is installed between the sheet input tray 201 and the reused sheet cassette 18.

The heating unit 202 of the erasing unit 20 heats the image printed on the reusable sheet input from the sheet input tray 201 so as to erase the image. The erasing unit 20 conveys the sheet from which the image is erased to the reused sheet cassette 18. The reused sheet cassette 18 accommodates the sheet from which the image is erased by the erasing unit 20 as the reused sheet Sr. The reused sheet Sr that is accommodated by the reused sheet cassette 18 is supplied to the printer unit 16, is subjected to an image printing operation again, and is discharged by the sheet discharging unit 19.

In a case where the user wants to reuse the sheet, there is a need to select the printing function of printing an image by using the process unit 164 for the first image forming function, that is, the erasable toner. The user may select the first image forming function by operating the image formation key K3 of the operation panel 12. For example, when the image formation key K3 receives the user's operation, a control mode of a control unit 101 to be described later becomes a printing mode. In the printing mode, the control unit 101 displays a print screen on the display unit 122 of the operation panel 12. The display unit 122 displays, for example, a print screen that causes the user to select any one image forming function of the copying function and the printing function and to select any one image forming function of the first and second image forming functions. The control unit 101 executes the image forming function by the image forming apparatus 10 in accordance with the user's selection result on the print screen. For example, when the first image forming function is selected by the user, the control unit 101 operates the process unit 164 so as to execute the first image forming function by the image forming apparatus 10.

As described above, the image forming apparatus 10 may use both the sheet Sn and the sheet Sr in order to print the image. Further, the image forming apparatus 10 may use the erasable toner and the inerasable toner in order to print the image. Furthermore, the image forming apparatus 10 may reuse the reusable sheet from which the image is erased as the sheet Sr by erasing the image printed by the erasable toner.

Figure 3:
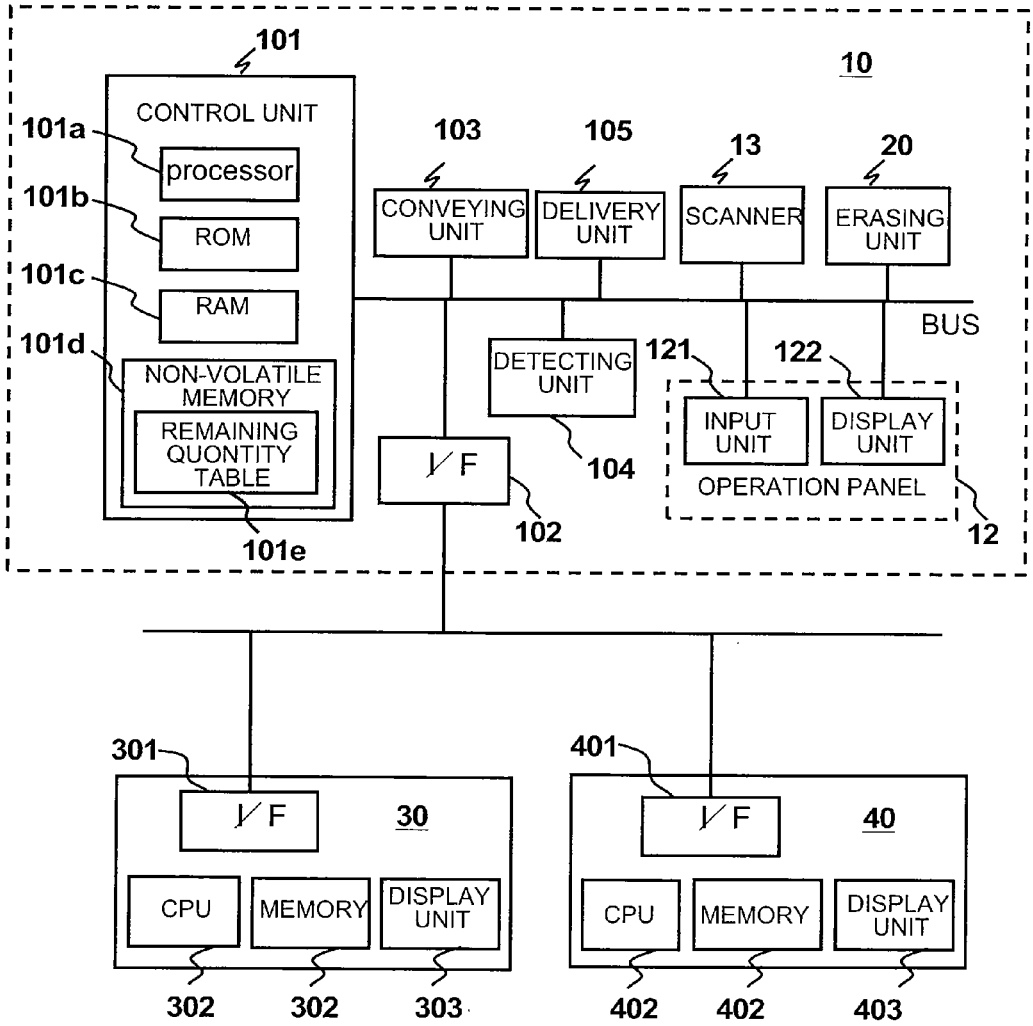
FIG. 3 is a block diagram illustrating a control configuration of the image forming apparatus according to the first embodiment.

FIG. 3 is a block diagram illustrating a control configuration of the image forming apparatus according to the first embodiment. As illustrated in FIG. 3, the control unit 101 of the image forming apparatus 10 includes a processor 101*a* configured as a CPU (Central Processing Unit) or an MPU (Micro Processing Unit), a ROM (Read Only Memory) 101*b*, a RAM (Random Access Memory) 101*c*, and a non-volatile memory 101*d*.

The control unit 101 controls the operation panel 12, the scanner 13, the erasing unit 20, a communication interface (I/F) 102, a conveying unit 103, a remaining sheet detecting unit 104, a delivery unit 105, and the like.

The conveying unit 103 conveys the sheets Sn and Sr from the cassettes 17 and 18 to the sheet discharging unit 19. The conveying unit 103 includes conveying rollers such as the transfer roller 21, the drive roller 22, the separation roller 23, and the registration roller 24 necessary for conveying the sheets and a drive motor that drives the conveying rollers.

The remaining sheet detecting unit 104 detects the remaining reused sheets Sr accommodated in the cassette 18 by a sensor. The remaining sheet detecting unit 104 detects the stacking height of the sheets Sr accommodated in the cassette 18 or the weight of the sheets Sr accommodated in the cassette 18 as the remaining sheets. Accordingly, the remaining sheet detecting unit 104 outputs a value representing the stacking height or the weight of the sheets Sr as a value representing the detected remaining sheets. The detected remaining sheets do not have to be the accurate quantity of sheets. Further, even when the remaining sheets are notified to the user based on the detection result of the remaining sheet detecting unit 104, the notified remaining sheets do not have to be the accurate quantity of sheets, for example, exactly how many sheets left. Based on the detection result of the remaining sheet detecting unit 104, the image forming apparatus 10 may notify a user of the necessity of replenishing the reused sheet Sr to the cassette 18.

The processor 101*a* generally controls the entire operation of the image forming apparatus 10. The processor 101*a* executes various processes by executing a program stored in the ROM 101*b*. The ROM 101*b* stores a control program and control data. The ROM 101*b* stores the number of times of reusing the sheet or the number of times of erasing the sheet as a threshold value for changing the heating temperature of the erasing unit 20. The ROM 101*b* stores a program for controlling the heating temperature of the erasing unit 20. Further, the ROM 101*b* stores a program for controlling the sheet conveying speed of the conveying unit 103.

The RAM 101*c* is used as a working memory or a buffer memory, and temporarily stores the data read by the scanner 13. The respective constituents of the control unit 101 and the image forming apparatus 10 are connected to one another via a bus BUS.

The non-volatile memory 101*d* is an updatable non-volatile memory. The non-volatile memory 101*d* stores a control program and control data. The non-volatile memory 101*d* stores a user ID number and a user mail address. The ID number is authentication information that is specifically allocated to the user. For example, when the user logs in the image forming apparatus 10 in order to use the image forming function and the image erasing function, the ID number is input by the use of the numerical key K1 of the operation panel 12. The non-volatile memory 101*d* stores the ID number by the input of the user and also stores the user mail address specified by the ID number. Further, the non-volatile memory 101*d* includes a remaining quantity table 101*e* that stores a value representing the quantity of the remaining reused sheets Sr of the image forming apparatus 10. Specifically, the remaining quantity table 101*e* stores the output value of the remaining sheet detecting unit 104 as the value representing the remaining reused sheets Sr.

The delivery unit 105 delivers a predetermined message to the user mail address stored in advance in the non-volatile memory 101*d* based on the operation of the user for the mail sending key K5 of the operation panel 12. The delivery unit 105 delivers the message to the user via the communication interface 102 by, for example, an e-mail.

The communication interface 102 is an interface that executes a communication with the client terminals 30 and 40 as external devices via a network 50.

The client terminal 30 includes a communication interface (I/F) 301, a CPU 302, a memory 303, and a display unit 304. The client terminal 40 includes a communication interface (I/F) 401, a CPU 402, a memory 403, and a display unit 404.

Figure 4:
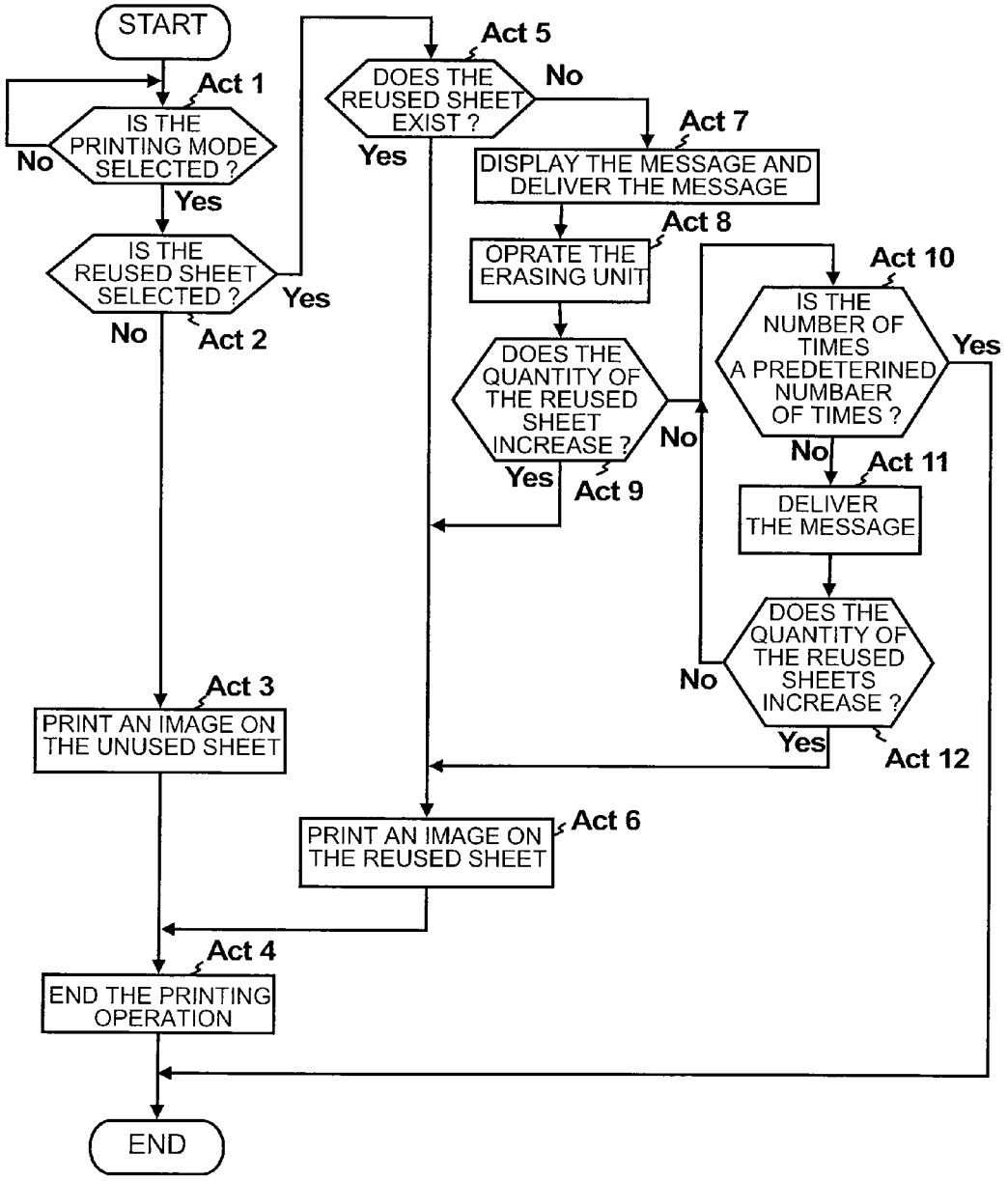
FIG. 4 is a flowchart illustrating a control operation of the image forming apparatus according to the first embodiment.

FIG. 4 is a flowchart illustrating a control operation of the image forming apparatus according to the first embodiment. Referring to FIG. 4, a print control operation using the reused sheet of the image forming apparatus 1 will be described.

In the description below, the user that currently uses the image forming apparatus 10 will be referred to as a current user. Further, the users that have used the image forming apparatus 10 will be referred to as the other users.

In Act 1, the control unit 101 of the image forming apparatus 10 determines whether the printing mode is selected by the current user. Specifically, for example, the control unit 101 determines whether the image formation key K3 is operated by the current user. When the control unit 101 determines that the printing mode is not selected by the current user (No in Act 1), the control unit 101 waits for the selection of the printing mode by the current user. When the control unit 101 determines that the printing mode is selected by the current user (Yes in Act 1), the operation of the image forming apparatus 10 proceeds to Act 2. In Act 2, the control unit 101 determines whether the unused sheet Sn or the reused sheet Sr is selected as the sheet for printing an image thereon by the current user. Specifically, the control unit 101 determines whether the sheet selected through the operation of the sheet selecting key K6 by the current user is the unused sheet Sn or the reused sheet Sr.

In Act 2, when the control unit 101 determines that the unused sheet Sn is selected by the current user (No in Act 2), the operation of the image forming apparatus 10 proceeds to Act 3. In Act 3, the control unit 101 controls the conveying unit 103, the image forming unit 16, and the like in order to print an image on the unused sheet Sn. Specifically, the control unit 101 controls the conveying unit 103 so that the unused sheet Sn is taken out from the cassette 17 and is conveyed to the image forming unit 16 in response to the operation of the start key K7 by the current user. Further, the control unit 101 controls the image forming unit 16 so that the process unit 163 for the inerasable toner is operated. The image forming unit 16 prints an image on the reused sheet Sr using the inerasable toner by the operation of the process unit 163 for the inerasable toner. In Act 4, after the image is printed, the control unit 101 controls the conveying unit 103 so that the sheet having an image printed thereon by the inerasable toner is conveyed to the sheet discharging unit 19. The sheet discharging unit 19 discharges the sheet having an image printed thereon to the outside of the image forming apparatus 10.

In Act 2, when the control unit 101 determines that the reused sheet Sr is selected by the current user (Yes in Act 2), the operation of the image forming apparatus 10 proceeds to Act 5. In Act 5, the control unit 101 determines whether the reused sheet Sr exists in the cassette 18 based on the output value from the remaining sheet detecting unit 104. When the control unit 101 determines that the reused sheet Sr exists in the cassette 18 (Yes in Act 5), the operation of the image forming apparatus 10 proceeds to Act 6. In Act 6, the control unit 101 controls the conveying unit 103, the image forming unit 16, and the like in order to print an image on the reused sheet Sr. Specifically, the control unit 101 controls the conveying unit 103 so that the reused sheet Sn is taken out from the cassette 17 and is conveyed to the image forming unit 16 in response to the operation of the start key K7 by the current user. Further, the control unit 101 controls the image forming unit 16 so that the process unit 164 for the erasable toner is operated. The image forming unit 16 prints an image on the reused sheet Sr using the erasable toner by the operation of the process unit 164 for the erasable toner. In Act 4 after the image is printed, the control unit 101 controls the conveying unit 103 so that the sheet having an image printed thereon by the erasable toner is conveyed to the sheet discharging unit 19. The sheet discharging unit 19 discharges the sheet having an image printed thereon to the outside of the image forming apparatus 10.

In Act 3 and Act 6, for example, when the first image forming function (the printing operation using the erasable toner) or the second image forming function (the printing operation using the inerasable toner) is selected through the operation of the operation panel 12 by the current user, the control unit 101 controls the image forming unit 16 in accordance with the selection of the current user through the operation panel 12. Accordingly, in Act 3, when the first image forming function is selected by the current user, the image forming unit 16 prints an image on the unused sheet Sn using the erasable toner by the operation of the process unit 164 for the erasable toner. In Act 6, when the second image forming function is selected by the current user, the image forming unit 16 prints an image on the reused sheet Sr using the inerasable toner by the operation of the process unit 163 for the inerasable toner.

Figure 5A:
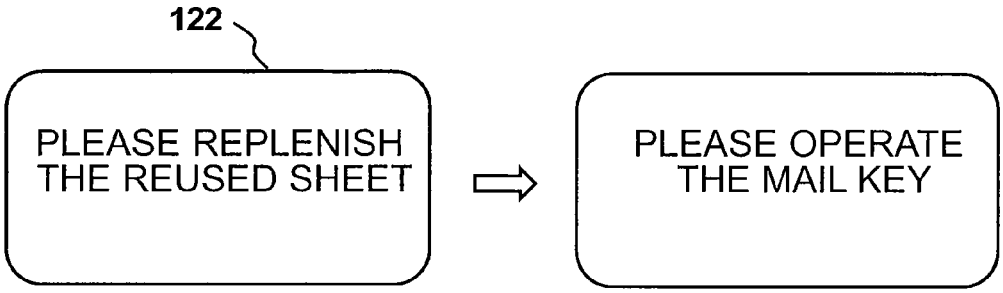
FIG. 5A is a diagram illustrating an example of a message that is displayed on a display unit of the operation panel used in the image forming apparatus according to the first embodiment.

In Act 5, when the control unit 101 determines that the reused sheet Sr does not exist in the cassette 18 (No in Act 5), the operation of the image forming apparatus 10 proceeds to Act 7. In Act 7, the control unit 101 controls the operation panel 12 so that a message as information for the user is displayed on the display screen of the display unit 122 of the operation panel 12. FIG. 5A is a diagram illustrating an example of the message displayed on the display unit 122. As illustrated in FIG. 5A, the display unit 122 displays, for example, a message of "please replenish the reused sheet" as the message prompting the replenishment of the reused sheet Sr to the cassette 18. Further, as illustrated in FIG. 5A, the display unit 122 displays, for example, a message of "please operate the mail key" as a message prompting the operation of the mail sending key K5. The display unit 122 may display the former message, followed by switching the screen to another screen, and may display the latter message on a separate screen. It is effective to display the former message and the latter message on separate screens in consideration of the long sentence of the message and the reliable delivery of the message content to the current user. Of course, the display unit 122 may display the former message and the latter message on the same screen at the same time.

In Act 5, the case where the reused sheet Sr does not exist is not limited to the case where the reused sheet Sr does not exist in the cassette 18. Specifically, the case where the reused sheet Sr does not exist refers to a case where the output value of the remaining sheet detecting unit 104 is a predetermined threshold value or less. The predetermined threshold value that is used to determine that "no sheet exists" by the control unit 101 as a result in which the weight of the sheet Sr accommodated in the cassette 18 is detected by the remaining sheet detecting unit 104 and is found that the remaining sheets are, for example, twenty sheets or less indicates a value that represents, for example, the weight of twenty sheets. The predetermined value when the remaining sheet detecting unit 104 detects the stacking height of the sheet Sr accommodated in the cassette 18 refers to a value that represents, for example, the stacking height (for example, 2 mm) of twenty sheets Sr.

Figure 5B:
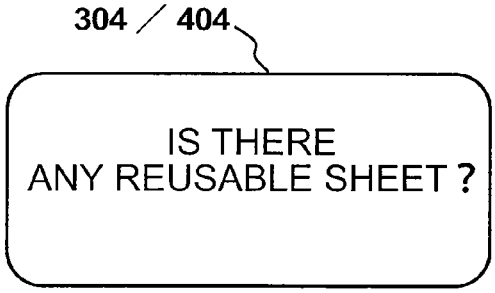
FIG. 5B is a diagram illustrating an example of a message that is delivered by a delivery unit of the image forming apparatus according to the first embodiment.

When the current user operates the mail sending key K5 in accordance with the message, the control unit 101, in Act 7, reads out the other users' mail addresses stored in the non-volatile memory 101*d* in response to the operation of the mail sending key K5 by the current user. The control unit 101 controls the delivery unit 105 so that the e-mail is transmitted to the read mail address at one time. FIG. 5B is a diagram illustrating information, for example, a message delivered to the other users by the delivery unit 105. The delivery unit 105 transmits a mail including, for example, a message of "is there any reusable sheet?" illustrated in FIG. 5B as a message for the other users. The delivery unit 105 delivers information requiring the other users to supply the reusable sheet by transmitting the e-mail including the message to the other users.

In Act 8, after the delivery of the message in Act 7, the control unit 101 checks whether the reusable sheet is input to the sheet input tray 201 by, for example, the other users. The control unit 101 confirms the input of the sheet by using, for example, a detection result of a sensor (not illustrated) installed in the tray 201. When the control unit 101 confirms the input of the sheet to the sheet input tray 201, the control unit operates the erasing unit 20. In Act 8, the heating unit 202 of the erasing unit 20 erases the image of the reusable sheet guided by the sheet input tray 201. The erasing unit 20 conveys the sheet from which the image is erased as the reused sheet Sr to the cassette 18. In other words, the erasing unit 20 supplies the reused sheet Sr to the reused sheet cassette 18.

In Act 9, after the supply of the reused sheet Sr, the control unit 101 determines whether the quantity of the reused sheets Sr of the reused sheet cassette 18 exceeds a predetermined quantity. Specifically, the control unit 101 determines whether the output value from the remaining sheet detecting unit 104 exceeds, for example, the predetermined threshold value. When the control unit 101 determines that the quantity of the reused sheets Sr exceeds the predetermined quantity (Yes in Act 9), the operation of the image forming apparatus 10 proceeds to Act 6. In Act 6, as described above, the control unit 101 controls the conveying unit 103 so that the reused sheet Sr is taken out from the reused sheet cassette 18 and is conveyed to the image forming unit 16. Further, the control unit 101 prints an image on the sheet Sr using an erasable toner by the operation of the process unit 164 for the erasable toner of the image forming unit 16. In Act 4, the control unit 101 controls the conveying unit 103 so that the sheet having an image printed thereon is conveyed to the sheet discharging unit 19. The sheet discharging unit 19 discharges the sheet having an image printed thereon to the outside of the image forming apparatus 10. In Act 9, when the control unit 101 determines that the quantity of the reused sheets Sr does not exceed the predetermined quantity (No in Act 9), the operation of the image forming apparatus 10 proceeds to Act 10. In Act 10, the control unit 101 determines whether the number of times of checking an increase in the quantity of the reused sheets Sr exceeds a predetermined number of times.

In Act 10, when the control unit 101 determines that the number of times of checking an increase in the quantity of the reused sheets Sr does not exceed the predetermined quantity (No in Act 10), the operation of the image forming apparatus 10 proceeds to Act 11. In Act 11, the control unit 101 reads out the other users' mail addresses stored in the non-volatile memory 101*d* again. The control unit 101 controls the delivery unit 105 so that the e-mail is transmitted to the read mail addresses at one time. The message of the e-mail that is transmitted again may be the message illustrated in FIG. 5B, but may be changed to a message that actively requires the other users to supply the reusable sheet. The delivery unit 105 delivers information requiring the other users to supply the reusable sheet by retransmitting the e-mail including the message. After the delivery of the message, the operation of the image forming apparatus 10 proceeds to Act 12.

In Act 10, when the control unit 101 determines that the number of times of checking an increase in the quantity of the reused sheets Sr exceeds a predetermined quantity (Yes in Act 10), the image forming apparatus 10 ends the request for the supply of the reusable sheet to other users.

In Act 10, the control unit 101 may determine whether the number of times of requiring the other users to supply the reusable sheet exceeds a predetermined number of times instead of determining whether the number of times of checking an increase in the quantity of the reused sheets Sr exceeds a predetermined number of times.

In Act 10, when the control unit 101 determines that the number of times of requiring the other users to supply the reusable sheet does not exceed the predetermined number of times (No in Act 10), the operation of the image forming apparatus 10 proceeds to Act 11.

In Act 10, when the control unit 101 determines that the number of times of requiring the other users to supply the reusable sheet exceeds the predetermined number of times (Yes in Act 10), the image forming apparatus 10 ends the request for the supply of the reusable sheet with respect to the other users. After the request for the supply of the reusable sheet, the image forming apparatus 10 newly executes the operation after ACT 1, for example, when the reused sheet Sr is supplied to the reused sheet cassette 18.

In Act 12, the control unit 101 determines whether the quantity of the reused sheets Sr of the reused sheet cassette 18 exceeds a predetermined quantity as in Act 9. When the control unit 101 determines that the quantity of the reused sheets Sr does not exceed the predetermined quantity (No in Act 12), the operation of the image forming apparatus 10 returns to Act 10.

In Act 12, when the control unit 101 determines that the quantity of the reused sheets Sr exceeds the predetermined quantity (Yes in Act 12), the operation of the image forming apparatus 10 proceeds to Act 6. In Act 6, as described above, the image forming apparatus 10 takes out the reused sheet Sr from the reused sheet cassette 18 and prints an image on the reused sheet Sr by an erasable toner. Further, in Act 4, as described above, the image forming apparatus 10 discharges the sheet having an image printed thereon by the erasable toner.

As described above, in Act 5, when the control unit 101 determines that the reused sheet Sr does not exist (No in Act 5), the operation of the image forming apparatus 10 proceeds to Act 7, and in Act 7, the display unit 122 displays the message of FIG. 5A. When the current user operates the mail sending key K5 in accordance with the display message, the image forming apparatus 10 delivers the message of FIG. 5B to the other users in order to require the other users to supply the reusable sheet as described above. In other words, the image forming apparatus 10 searches for the other users that have the reusable sheet having an image printed thereon by the first image forming function and may supply the sheet. However, there is a case in which the current user of the image forming apparatus 10 may not wait for the supply of the reusable sheet from the other users. When the current user may not wait for the supply of the reusable sheet from the other users, the current user may print an image on the remaining reused sheet Sr if the reused sheet Sr remains in the cassette 18 without operating the mail sending key K5. Specifically, the control unit 101 controls the conveying unit 103 so that the remaining reused sheet Sr is taken out from the cassette 18 and is conveyed to the image forming unit 16 in response to, for example, the operation of the start key K7 by the current user in a state where the display unit 122 displays the message of FIG. 5A. Further, when the reused sheets Sr in the cassette 18 runs out, the current user may print an image on the unused sheet Sn accommodated in the cassette 17. Specifically, the control unit 101 controls the display unit 122 to display that the reused sheet Sr remaining in the cassette 18 is used up. After this display, when the control unit 101 determines that the unused sheet Sn is selected by the operation of the sheet selecting key K6 by the current user, the control unit 101 controls the conveying unit 103 so that the unused sheet Sn is taken out from the cassette 17 and is conveyed to the image forming unit 16. After the printing operation is ended by the current user, the image forming apparatus 10 automatically executes the operation after Act 7.

For example, in Act 7, the control unit 101 controls the delivery unit 105 so that the message of FIG. 5B is automatically delivered to the other users and the operation after Act 7 is executed even when the mail sending key K5 is not operated by the current user after the current user ends the printing operation.

In the routine repeated from Act 10 to Act 12, the interval of delivering the e-mail of the message a predetermined number of times when the quantity of the reused sheets Sr does not exceed the predetermined quantity is arbitrarily set as, for example, every one hour or every half a day by the current user through the operation panel 12. When the reusable sheet is supplied during the time in which the e-mail of the message is delivered the predetermined number of times, the e-mail notifying the other users of the supply of the reusable sheet may be delivered. The supply of the reusable sheet by the other users is recognized by the control unit 101, for example, when the quantity of the reused sheets Sr exceeds the predetermined quantity in Act 10.

As described above, the current user may select a printing operation (the first image forming function) using the erasable toner or a printing operation (the second image forming function) using the inerasable toner before the printing operation. Further, the current user may select any sheet of the unused sheet Sn and the reused sheet Sr for the printing operation. When the reused sheet Sr is selected by the current user, the image forming apparatus 10 delivers information requiring the other users to supply the reusable sheet, the other users being stored in the image forming apparatus 10 based on the quantity of the reused sheets Sr remaining in the cassette 18.

According to the first embodiment, information requiring the supply of the reusable sheet is delivered to the users that have printed an image by the erasable toner. Thus, according to the image forming apparatus 10, it is possible to effectively use the sheet that is printed to be reused later and to arrange the unnecessary sheets.

Figure 6:
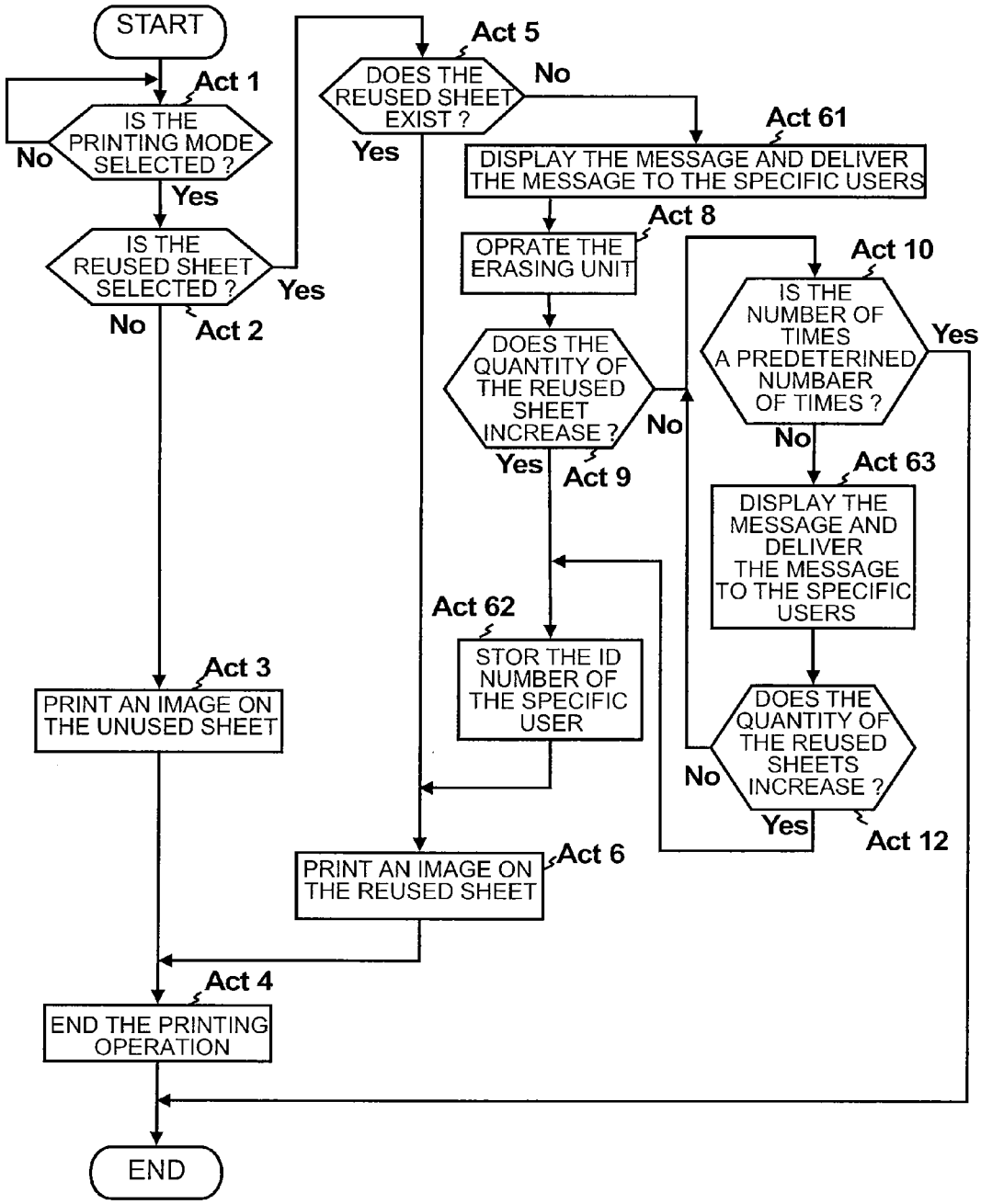
FIG. 6 is a flowchart illustrating a control operation of an image forming apparatus according to a second embodiment.

Hereinafter, the control operation of the image forming apparatus 10 according to a second embodiment will be described by referring to FIG. 6. FIG. 6 is a flowchart illustrating the control operation of the image forming apparatus 10 according to the second embodiment. In FIG. 6, the same Act number will be given to the same operation as that of the flowchart of FIG. 4, and the control operation of the image forming apparatus 10 according to the second embodiment will be described by focusing on the differences from those of the flowchart of FIG. 4.

In the description of the second embodiment below, the user that currently uses the image forming apparatus 10 will be referred to as a current user. The users that have used the image forming apparatus 10 will be referred to as the other users. Further, the users that have used the first image forming function among the other users will be referred to as specific users.

In order to distinguish the other users from the specific users, the control unit 101 of the image forming apparatus 10 causes the non-volatile memory 101*d* to store not only the ID numbers of the other users and the mail addresses corresponding to the ID numbers, but also to store information in which the other users used the first image forming function, that is, information in which the printing operation is performed by the erasable toner, corresponding to each of the ID numbers. The information in which the printing operation is performed by the erasable toner includes, for example, the quantity of the sheets used to print an image thereon by the erasable toner. The control unit 101 recognizes the other users that performed the printing operation for at least one sheet using the erasable toner as the specific users.

As will be described later in Act 62, the control unit 101 of the image forming apparatus 10 causes the non-volatile memory 101*d* to store the information on the supply of the reusable sheet by the specific users, corresponding to each of the ID numbers. The information on the supply of the reusable sheet includes the quantity of the reusable sheets supplied by the specific users. Accordingly, the non-volatile memory 101*d* stores not only the ID number, but also the mail address, the information on printing using the erasable toner, and the reusable sheet supply information, corresponding to the ID number.

Further, the control unit 101 recognizes the specific users that have printed a large quantity of sheets by the erasable toner among the specific users based on the quantity of the sheets having an image printed thereon by the erasable toner. Furthermore, the control unit 101 recognizes the reusable sheet supply ratio for each specific user based on the quantity of the sheets having an image printed thereon by the erasable toner and the quantity of the supplied reusable sheets.

The image forming apparatus 10 according to the second embodiment executes the operation of Act 61 for urging the specific users to supply the reusable sheets instead of Act 7 of FIG. 4. Further, the image forming apparatus 10 executes the operation of Act 62 for storing the specific users that supplied the reusable sheets in the non-volatile memory 101*d* between the case of Yes in Act 9 and Act 6 of FIG. 4. Furthermore, the image forming apparatus 10 executes the operation of Act 63 for urging the specific users to supply the reusable sheet instead of the operation of Act 11 of FIG. 4.

In Act 5, when the control unit 101 determines that the reused sheet Sr does not exist in the cassette 18, the operation of the image forming apparatus 10 proceeds to Act 61. In Act 61, the control unit 101 controls the operation panel 12 so that the message of FIG. 5A is displayed on the display unit 122 of the operation panel 12. Specifically, the display unit 122 displays the message of "please replenish the reused sheet" of FIG. 5A. Subsequently, the display unit 122 displays the message of "please operate the mail key" of FIG. 5A. When the current user operates the mail sending key K5 in accordance with the latter message, the control unit 101, in Act 61, reads out the specific user mail addresses stored in the non-volatile memory 101*d* in response to the operation of the mail sending key K5 by the current user. The control unit 101 controls the delivery unit 105 so that the e-mail is transmitted to the read mail address. The delivery unit 105 transmits the mail including the message of FIG. 5B to the read mail address. The delivery unit 105 delivers information requiring the specific users to supply the reusable sheet by transmitting the e-mail including the message.

After the delivery of the message in Act 61, the control unit 101, in Act 8, checks whether the reusable sheet is input to the sheet input tray 201. When the control unit 101 confirms the input of the sheet into the sheet input tray 201, the control unit operates the erasing unit 20. In Act 8, the heating unit 202 of the erasing unit 20 erases the image of the reusable sheet guided to the sheet input tray 201. The erasing unit 20 conveys the sheet from which the image is erased as the reused sheet to the cassette 18. In other words, the erasing unit 20 supplies the reused sheet Sr to the reused sheet cassette 18. After the supply of the reused sheet Sr, the operation of the image forming apparatus 10 proceeds to Act 9.

In Act 9, the control unit 101 determines whether the quantity of the reused sheets Sr of the reused sheet cassette 18 exceeds a predetermined quantity. When the control unit 101 determines that the quantity of the reused sheets Sr exceeds the predetermined quantity (Yes in Act 9), the operation of the image forming apparatus 10 proceeds to Act 62. In Act 62, the control unit 101 stores the ID number of the specific user that supplies the reusable sheet in the non-volatile memory 101*d*. Further, the control unit 101 stores the quantity of the supplied reusable sheets as the reusable sheet supply information. For example, when the user supplies the reusable sheet to the image forming apparatus 10, that is, the reusable sheet is input to the sheet input tray 201, the ID number for logging in the image forming apparatus 10 is input by the numerical key K1 in advance. When the input ID number is not stored in the non-volatile memory 101*d*, the control unit 101 stores the ID number in the non-volatile memory 101*d* as a new user. Further, the control unit 101 stores the quantity of the supplied reusable sheets, corresponding to the newly stored ID number. When the input ID number is already stored in the non-volatile memory 101*d*, the control unit 101 reads the quantity of the supplied reusable sheets stored corresponding to the stored ID number. The control unit 101 newly stores the quantity obtained by adding the quantity of the newly supplied reusable sheets to the read quantity in the non-volatile memory 101*d*. The control unit obtains information on the quantity of the supplied reusable sheets by counting the quantity of the reusable sheets passing by the heating unit 202 through, for example, a sensor.

After storing the information on the user that supplied the reusable sheet, the operation of the image forming apparatus 10 proceeds to Act 6. In Act 6, as described above, the control unit 101 controls the conveying unit 103 so that the reused sheet Sr is taken out from the reused sheet cassette 18 and the sheet Sr is conveyed to the image forming unit 16. Further, the control unit 101 prints an image on the sheet Sr by the erasable toner by the operation of the process unit 164 for the erasable toner of the image forming unit 16. In Act 4, the control unit 101 controls the conveying unit 103 so that the sheet Sr having an image printed thereon is conveyed to the sheet discharging unit 19. The sheet discharging unit 19 discharges the sheet Sr having an image printed thereon to the outside of the image forming apparatus 10.

In Act 9, when the control unit 101 determines that the quantity of the reused sheets Sr does not exceed the predetermined quantity (No in Act 9), the operation of the image forming apparatus 10 proceeds to Act 10. In Act 10, the control unit 101 determines whether the number of times of checking an increase in the quantity of the reused sheets Sr exceeds a predetermined number of times.

In Act 10, when the control unit 101 determines that the number of times of checking an increase in the quantity of the reused sheets Sr does not exceed the predetermined number of times (No in Act 10), the operation of the image forming apparatus 10 proceeds to Act 63. In Act 63, the control unit 101 controls the operation panel 12 so that the message of FIG. 5A is displayed on the display unit 122 of the operation panel 12. Specifically, the display unit 122 displays the message of "please replenish the reused sheet" of FIG. 5A and displays the message of "please operate the mail key" of FIG. 5A. When the current user operates the mail sending key K5 in accordance with the latter message, the control unit 101, in Act 63, reads out the specific user mail addresses stored in the non-volatile memory 101*d* again in response to the operation of the mail sending key K5 by the current user. The control unit 101 controls the delivery unit 105 so that the e-mail is transmitted to the read mail addresses again. The delivery unit 105 transmits the e-mail including the message of FIG. 5B to the read mail addresses. The content of the transmitted message may be changed to a message more actively urging the supply of the reusable sheet in relation to the message of FIG. 5B. The delivery unit 105 delivers information requiring the supply of the reusable sheet to the specific users by retransmitting the e-mail including the message again. After the delivery of the message, the operation of the image forming apparatus 10 proceeds to Act 12.

In Act 10, when the control unit 101 determines that the number of times of checking an increase in the quantity of the reused sheets Sr exceeds the predetermined number of times (Yes in Act 10), the image forming apparatus 10 ends the request of the reusable sheet to the specific user.

In Act 10, the control unit 101 may determine whether the number of times of requiring the specific users to supply the reusable sheet exceeds a predetermined number of times instead of determining whether the number of times of checking an increase in the quantity of the reused sheets Sr exceeds the predetermined number of times.

In Act 10, when the control unit 101 determines that the number of times of requiring the specific users to supply the reusable sheet does not exceed the predetermined number of times (No in Act 10), the operation of the image forming apparatus 10 proceeds to Act 11.

In Act 10, when the control unit 101 determines that the number of times of requiring the specific users to supply the reused sheet Sr exceeds the predetermined number of times (Yes in Act 10), the image forming apparatus 10 ends the request of the supply of the reused sheet Sr to the specific users. After the request of the supply of the reused sheet Sr ends, the image forming apparatus 10 newly executes the operation after ACT 1, for example, when the reused sheet Sr is supplied to the reused sheet cassette 18.

In Act 12, the control unit 101 determines whether the quantity of the reused sheets Sr of the reused sheet cassette 18 exceeds a predetermined quantity. When the control unit 101 determines that the quantity of the reused sheets Sr does not exceed the predetermined quantity (No in Act 12), the operation of the image forming apparatus 10 returns to Act 10.

In Act 12, when the control unit 101 determines that the quantity of the reused sheets Sr exceeds the predetermined quantity (Yes in Act 12), the operation of the image forming apparatus 10 proceeds to Act 62. In Act 62, as described above, the control unit 101 stores information on the user that supplied the reusable sheet in the non-volatile memory 101*d*.

After storing the information on the user that supplied the reusable sheet, as described above, the image forming apparatus 10, in Act 6, takes out the reused sheet Sr from the reused sheet cassette 18 and prints an image on the reused sheet Sr by the erasable toner. Further, in Act 4, as described above, the image forming apparatus 10 discharges the reused sheet Sr having an image printed thereon by the erasable toner.

According to the second embodiment, the e-mail including the message requiring the supply of the reusable sheet is delivered only to the specific users that are stored in the non-volatile memory 101*d* of the image forming apparatus 10. Accordingly, it is possible to reduce the trouble in which the user other than the specific users receives the e-mail including the above-described message.

The embodiments are not limited to the above-described configuration. For example, when requiring the user to supply the reusable sheet by delivering the e-mail including the above-described message, a message urging the printing operation using the erasable toner may be delivered to the users other than the specific users or the other specific users that printed an image on a small quantity of printing sheets by the erasable toner among the users stored in the image forming apparatus, differently from the specific users that printed an image on a large quantity of printing sheets. Accordingly, it is possible to urge the printing operation using the erasable toner by changing the content of the message with respect to the user in response to the quantity of printing sheets using the erasable toner.

In addition, the users to which the e-mail including the above-described message is delivered may be defined based on the reusable sheet supply ratio. In response to the reusable sheet supply ratio, the content of the message to the specific users may be changed.

Further, the message content of the e-mail when requiring the user to supply the reusable sheet may include not only the reusable sheet kept by the user, but also the reusable sheet kept by the group of the user. The reusable sheet to be supplied by the user is a sheet from which an image is not erased, but may be the sheet (the reused sheet) from which an image is erased already. When the sheet supplied by the user is the sheet from which an image is erased already, the user directly supplies the sheet to the reused sheet cassette 18. In a case of the sheet (the reusable sheet) from which an image is not erased, the user inputs the sheet into the sheet input tray 201, erases an image therefrom by the erasing unit, and supplies the sheet to the reused sheet cassette 18.

Further, the embodiments have been described by exemplifying the image forming apparatus that uses the erasable toner, but the image forming apparatus may be an inkjet-type image forming apparatus that uses erasable ink as an erasable color material. Furthermore, an e-mail including a message urging the printing operation using the erasable toner and requiring the supply of the reusable sheet may be periodically delivered to the users stored in the image forming apparatus until a predetermined quantity of the reused sheets are stacked in the sheet cassette.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus that has an image forming function of forming an image on a recording medium and an erasing function of erasing an image formed on a recording medium, the image forming apparatus comprising:

an image forming unit configured to form an image on a recording medium by an erasable color material and an inerasable color material;

a delivery unit configured to deliver information requiring a user to supply the recording medium having an image formed thereon by the erasable color material to the apparatus; and an erasing unit configured to erase the image formed on the recording medium supplied to the apparatus.

2. The image forming apparatus according to claim 1, further comprising:

an acquiring unit that acquires authentication information for authenticating users, wherein the delivery unit delivers the information to the users specified by the authentication information.

3. The image forming apparatus according to claim 2, further comprising:

a storage unit that stores the authentication information and user information including user mail addresses specified by the authentication information, wherein the delivery unit sends the information by transmitting an e-mail to the mail addresses.

4. The image forming apparatus according to claim 3, wherein the user information includes information in which the image is formed by the erasable color material.

5. The image forming apparatus according to claim 4, wherein the delivery unit delivers the information in which the image is formed by the erasable color material to the users based on the user information.

6. The image forming apparatus according to claim 5, wherein the delivery unit delivers the information to the users with a large quantity of recording mediums having an image formed thereon by the erasable color material based on the user information.

7. The image forming apparatus according to claim 4, wherein the user information includes information in which the recording medium is supplied to the apparatus, and the delivery unit delivers the information to the users that use the erasable color material and supply a small quantity of the recording mediums based on the user information.

8. The image forming apparatus according to claim 7, wherein the delivery unit changes the content of the delivered information for each user based on the user information.

9. The image forming apparatus according to claim 1, further comprising:

a cassette that accommodates the recording medium having an image formed thereon by the image forming unit, wherein the delivery unit delivers the information when the quantity of the recording mediums accommodated in the cassette is a predetermined quantity or less.

10. The image forming apparatus according to claim 9, wherein the erasing unit supplies the recording medium from which the image is erased to the cassette.

* * * * *